US012693012B2

(12) United States Patent
Hoke

(10) Patent No.: US 12,693,012 B2
(45) Date of Patent: Jul. 28, 2026

(54) TORCH DEVICE CONFIGURED TO DISTRIBUTE HEAT AROUND THE PERIPHERY OF AN OBJECT

(71) Applicant: Cory Hoke, Pittsburgh, PA (US)

(72) Inventor: Cory Hoke, Pittsburgh, PA (US)

(73) Assignee: Cory Hoke, Pittsburgh, PA (US)

( * ) Notice: Subject to any disclaimer, the term of this patent is extended or adjusted under 35 U.S.C. 154(b) by 377 days.

(21) Appl. No.: 18/446,510

(22) Filed: Aug. 9, 2023

(65) Prior Publication Data

US 2024/0053008 A1 Feb. 15, 2024

Related U.S. Application Data

(60) Provisional application No. 63/397,430, filed on Aug. 12, 2022.

(51) Int. Cl.
*F23Q 2/28* (2006.01)
*F23Q 2/36* (2006.01)
*F23Q 2/42* (2006.01)

(52) U.S. Cl.
CPC ..... *F23Q 2/282* (2013.01); *F23Q 2/36* (2013.01); *F23Q 2/42* (2013.01)

(58) Field of Classification Search
CPC . F23Q 2/42; F23Q 2/282; F23Q 2/165; F23Q 2/02; F23Q 7/14; F23Q 2/36; F23Q 13/04
See application file for complete search history.

(56) References Cited

U.S. PATENT DOCUMENTS

| | | | | |
|---|---|---|---|---|
| 1,689,720 | A | 10/1928 | Grunow et al. | |
| 2,242,394 | A | 5/1941 | Harriss | |
| 3,227,379 | A | 1/1966 | Suchowolec | |
| 3,873,262 | A * | 3/1975 | Pogrell | F23Q 2/282 431/255 |
| 4,749,351 | A * | 6/1988 | Mahoney | F23Q 2/50 431/143 |
| 5,755,568 | A | 5/1998 | Buhler | |
| 6,467,703 | B1 * | 10/2002 | Pearl, II | F23D 14/52 239/548 |
| 6,589,045 | B2 | 7/2003 | Xu | |
| 6,905,329 | B2 | 6/2005 | Wong | |
| 9,869,470 | B1 | 1/2018 | Chen | |
| 12,385,639 | B2 * | 8/2025 | Siddiqi | F23Q 2/287 |
| 2004/0209213 | A1 | 10/2004 | Wong | |
| 2014/0057220 | A1 * | 2/2014 | Reese | F23Q 2/20 431/344 |
| 2017/0219205 | A1 | 8/2017 | Eiseman | |
| 2021/0289836 | A1 | 9/2021 | Hon | |

* cited by examiner

*Primary Examiner* — Alfred Basichas
(74) *Attorney, Agent, or Firm* — The Webb Law Firm

(57) ABSTRACT

A torch device includes: a housing having a thermal energy source positioned therein; an ignition button operatively connected to the thermal energy source; and a thermal energy producing structure extending from a first end of the housing and operatively connected to the thermal energy source. The thermal energy producing structure includes an inner surface, an outer surface, an opening defined by the inner surface, and at least one orifice positioned around a periphery of the thermal energy producing structure such that thermal energy produced at the at least one opening is distributed evenly around a peripheral circumference of an object positioned within the opening.

20 Claims, 4 Drawing Sheets

TORCH DEVICE CONFIGURED TO DISTRIBUTE HEAT AROUND THE PERIPHERY OF AN OBJECT

This application claims priority to U.S. Provisional Patent Application No. 63/397,430 filed Aug. 12, 2022, the disclosure of which is hereby incorporated by reference in its entirety.

BACKGROUND OF THE DISCLOSURE

Field of the Disclosure

The present disclosure generally relates to a torch device and, more specifically, to a torch device that evenly distributes heat around the peripheral circumference of an object.

Description of Related Art

A lighter is a commonly used device for lighting cigarettes and cigars. Generally, a lighter provides a single visible flame. These lighters are suitable for typical cigarettes. However, these lighters typically provide a weak flame for cigars, which are greater in diameter than cigarettes. Therefore, a stronger flame is needed to light a cigar.

Furthermore, providing a single flame to a cigar causes the cigar to burn irregularly. Once the cigar is lit, the moisture differential within the rolled tobacco creates a burn that migrates unevenly throughout the cigar. A cigar user may apply moisture to the area of a cigar that burns briskly. Alternatively, a cigar user may apply a single flame lighter to different areas of the cigar to correct the cigar's burn. However, these methods are imprecise and inconsistent in resolving uneven migration of cigar burn. The present disclosure improves upon the deficiencies of the current cigarette and cigar lighters.

SUMMARY OF THE DISCLOSURE

An object of the present disclosure is to provide a torch device that evenly distributes heat around the peripheral circumference of an object, such as a cigar or cigarette. The thermal energy, such as a flame, generated by the device will radiate from the periphery of the device to completely encompass the peripheral circumference of the object. Accordingly, the thermal energy or flame, will be produced, to touch the whole peripheral circumference of the object to help with an even burn.

The present disclosure is directed to a torch device that may comprise: a housing having a thermal energy source positioned therein; an ignition button operatively connected to the thermal energy source; and a thermal energy producing structure extending from a first end of the housing and operatively connected to the thermal energy source. The thermal energy producing structure comprises an inner surface, an outer surface, an opening defined by the inner surface, and at least one orifice positioned around a periphery of the thermal energy producing structure such that thermal energy produced at the at least one opening is distributed evenly around a peripheral circumference of an object positioned within the opening.

In some non-limiting embodiments, the thermal energy source may comprise a fuel tank configured to store fuel and the device further comprises an electrical ignition wire positioned within the housing and configured to ignite the fuel when activated by the ignition button. The ignition button may be configured to ignite the fuel at the at least one orifice and allow fuel to flow from the fuel tank to the at least one orifice. In other non-limiting embodiments, the thermal energy source may comprise at least one battery and the device may further comprise at least one wire connected between the at least one battery and at least one resistive heating element positioned within the at least one orifice that is configured to be activated by the ignition button.

The opening defined by the inner surface may be a closed loop. The closed loop of the device may be circular. The closed loop may define at least three distinct sides. The at least three distinct sides form a shape chosen from a group comprising: a triangle, a rectangle, a pentagon, a hexagon, a heptagon, or any shape.

In one non-limiting embodiment, the at least one orifice may comprise a plurality of nozzles disposed on the inner surface of the thermal energy producing structure. The plurality of nozzles may protrude outwardly from the inner surface or may be flush on the inner surface of the housing.

The present disclosure is also directed to a thermal energy producing structure configured to be coupled to a handheld housing having a thermal energy source positioned there. The thermal energy producing structure comprises: an inner surface; an outer surface; an opening defined by the inner surface; and at least one orifice positioned around a periphery of the thermal energy producing structure such that thermal energy produced at the at least one orifice is distributed evenly around a peripheral circumference of an object positioned within the opening.

The opening defined by the inner surface may be a closed loop. The closed loop may be circular. The closed loop may define at least three distinct sides. The at least three distinct sides form a shape chosen from a group comprising: a triangle, a rectangle, a pentagon, a hexagon, or a heptagon. The at least one nozzle may protrude outwardly from the inner surface. The at least one orifice comprises a plurality of nozzles disposed on the inner surface of the structure. The plurality of nozzles may protrude outwardly from the inner surface or may be flush on the inner surface of the housing. The plurality of nozzles may be configured to direct thermal energy towards the center of the opening.

Other exemplary embodiments or aspects are set forth in the following numbered clauses.

Clause 1: A torch device comprising: a housing having a thermal energy source positioned therein; an ignition button operatively connected to the thermal energy source; and a thermal energy producing structure extending from a first end of the housing and operatively connected to the thermal energy source, wherein the thermal energy producing structure comprises an inner surface, an outer surface, an opening defined by the inner surface, and at least one orifice positioned around a periphery of the thermal energy producing structure such that thermal energy produced at the at least one opening is distributed evenly around a peripheral circumference of an object positioned within the opening.

Clause 2: The device of clause 1, wherein the thermal energy source comprises a fuel tank configured to store fuel and the device further comprises an electrical ignition wire positioned within the housing and configured to ignite the fuel when activated by the ignition button.

Clause 3: The device of clause 2, the ignition button is configured to ignite the fuel at the at least one orifice and allow fuel to flow from the fuel tank to the at least one orifice.

Clause 4: The device of clause 1, wherein the thermal energy source comprises at least one battery and the device further comprises at least one wire connected between the at least one battery and at least one resistive heating element positioned within the at least one orifice that is configured to be activated by the ignition button.

Clause 5: The device of any of clauses 1-4, wherein the opening defined by the inner surface is a closed loop.

Clause 6: The device of clause 5, wherein the closed loop is circular.

Clause 7: The device of clause 5, wherein the closed loop defines at least three distinct sides.

Clause 8: The device of clause 7, wherein the at least three distinct sides form a shape chosen from a group comprising: a triangle, a rectangle, a pentagon, a hexagon, or a heptagon.

Clause 9: The device of any of clauses 1-8, wherein the at least one orifice comprises a plurality of nozzles disposed on the inner surface of the thermal energy producing structure.

Clause 10: The device of clause 9, wherein the plurality of nozzles protrudes outwardly from the inner surface.

Clause 11: The device of clauses 9 or 10, wherein the plurality of nozzles is flush on the inner surface of the housing.

Clause 12: A thermal energy producing structure configured to be coupled to a handheld housing having a thermal energy source positioned therein, the thermal energy producing structure comprising: an inner surface; an outer surface; an opening defined by the inner surface; and at least one orifice positioned around a periphery of the thermal energy producing structure such that thermal energy produced at the at least one orifice is distributed evenly around a peripheral circumference of an object positioned within the opening Clause 13: The structure of clause 12, wherein the opening defined by the inner surface is a closed loop.

Clause 14: The structure of clauses 12 or 13, wherein the closed loop is circular.

Clause 15: The structure of clauses 12 or 13, wherein the closed loop defines at least three distinct sides.

Clause 16: The structure of clause 15, wherein the at least three distinct sides form a shape chosen from a group comprising: a triangle, a rectangle, a pentagon, a hexagon, or a heptagon.

Clause 17: The structure of any of clauses 12-16, wherein the at least one orifice comprises a plurality of nozzles disposed on the inner surface of the structure.

Clause 18: The structure of clause 17, wherein each of the plurality of nozzles protrudes outwardly from the inner surface.

Clause 19: The structure of clause 17, wherein each of the plurality of nozzles is flush on the inner surface of the structure.

Clause 20: The structure of clause 12-19, wherein each of the plurality of nozzles is configured to direct the thermal energy towards the center of the opening.

BRIEF DESCRIPTION OF THE DRAWINGS

The above-mentioned and other features and advantages of this disclosure, and the manner of attaining them, will become more apparent and the disclosure itself will be better understood by reference to the following descriptions of embodiments of the disclosure taken in conjunction with the accompanying drawings.

Figures 1A, 1B:
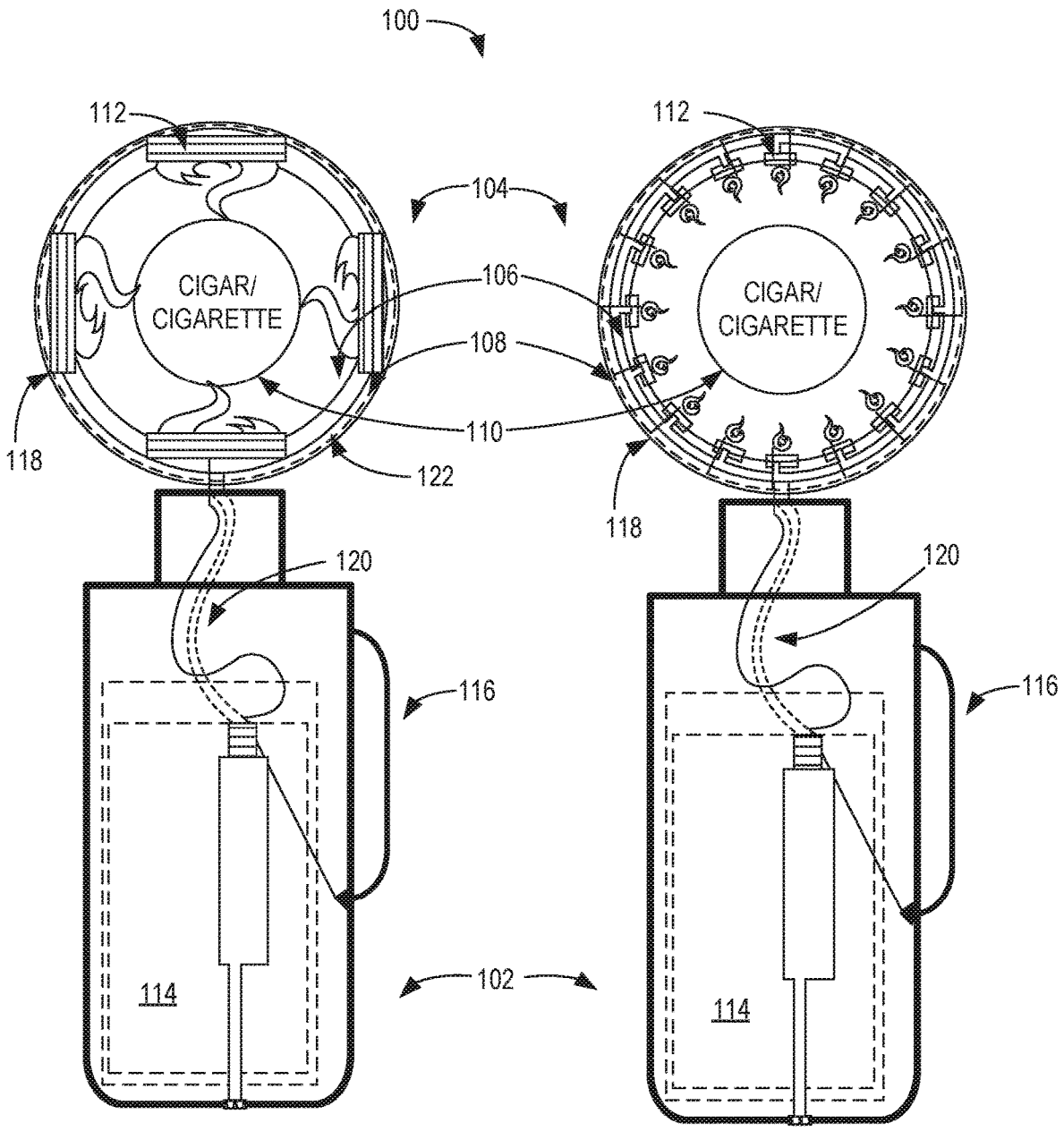
FIG. 1A is a perspective view of a torch device according to a non-limiting embodiment.
FIG. 1B is a perspective view of the torch device according to another non-limiting embodiment.
Figure 2B:
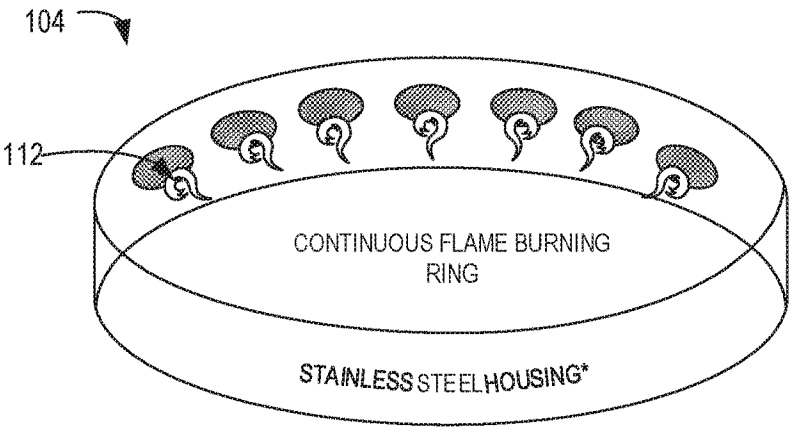
FIGS. 2A-2B are side views of the thermal energy producing structure of the torch device according to non-limiting embodiments.
Figure 3B:
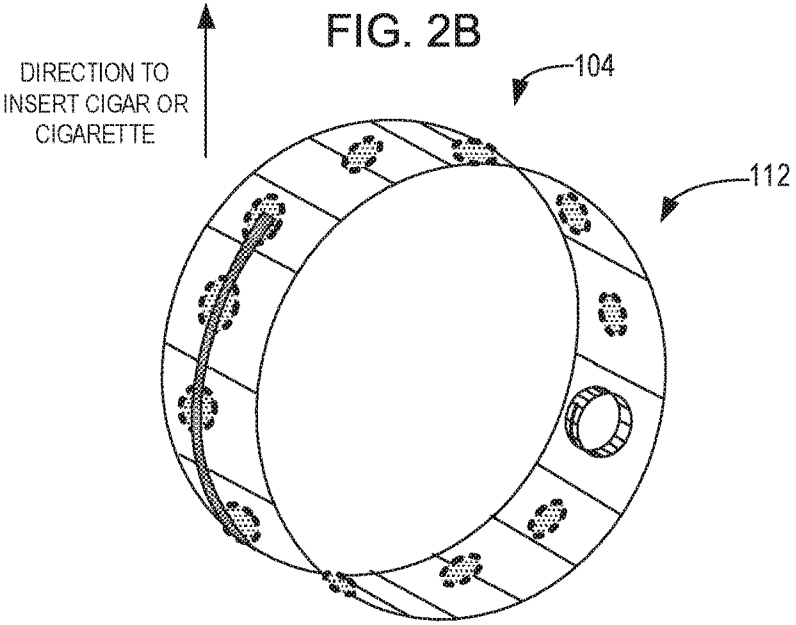
FIGS. 3A-3B are perspective views of the thermal energy producing structure of the torch device according to non-limiting embodiments.
Figure 2A:
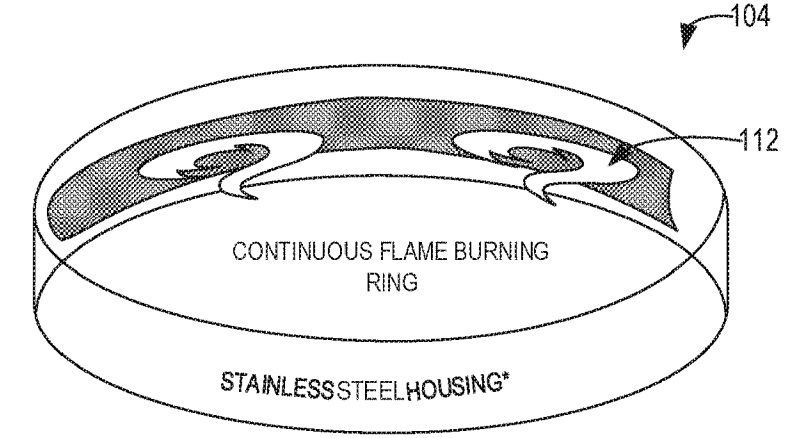
Figure 3A:
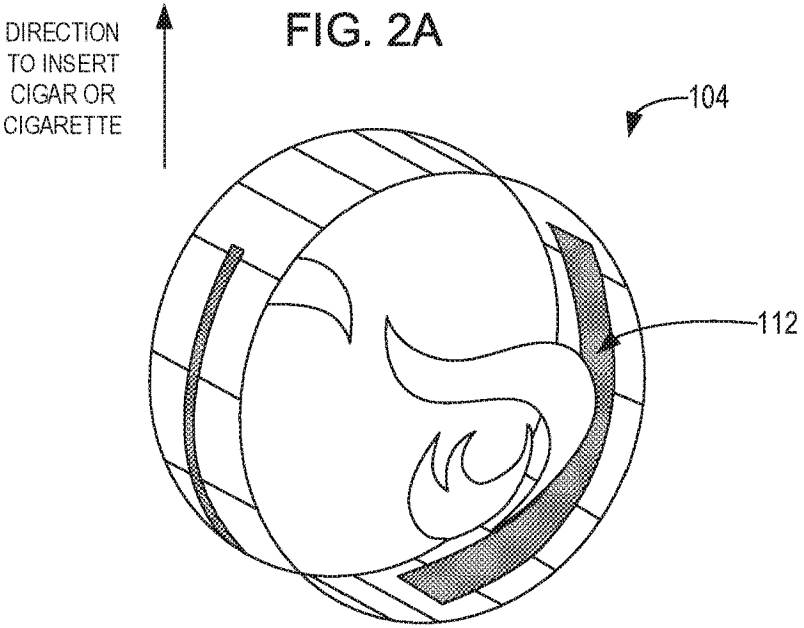
Figure 4A:
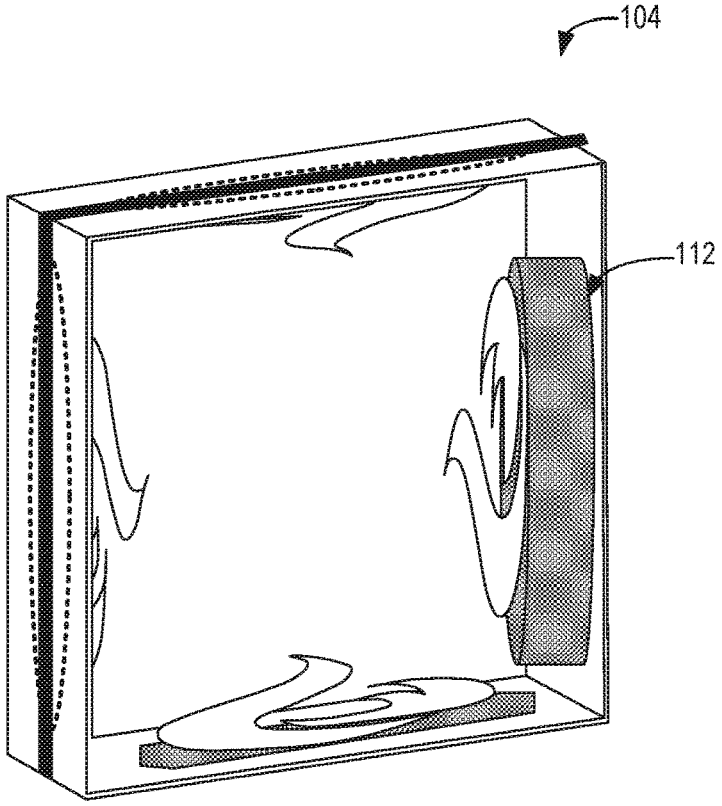
FIGS. 4A-4B are perspective views of the thermal energy producing structure of the torch device according to non-limiting embodiments.
Figure 4B:
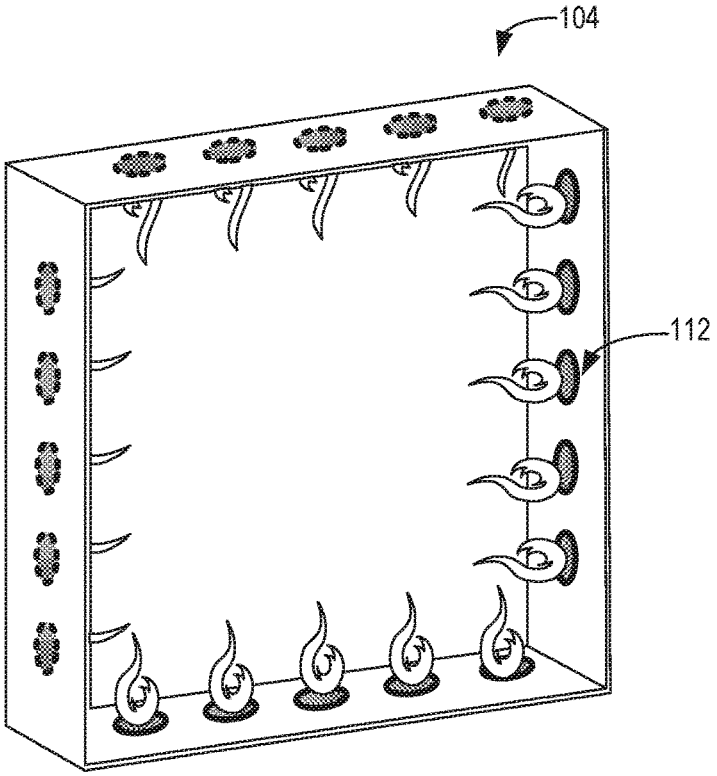
Figure 5A:
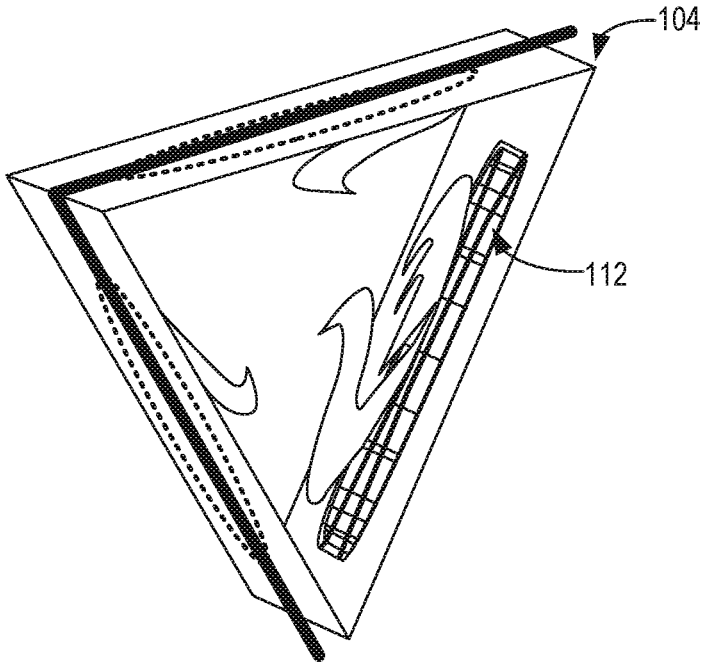
FIGS. 5A-5B are perspective views of the thermal energy producing structure of the torch device according to non-limiting embodiments.
Figure 5B:
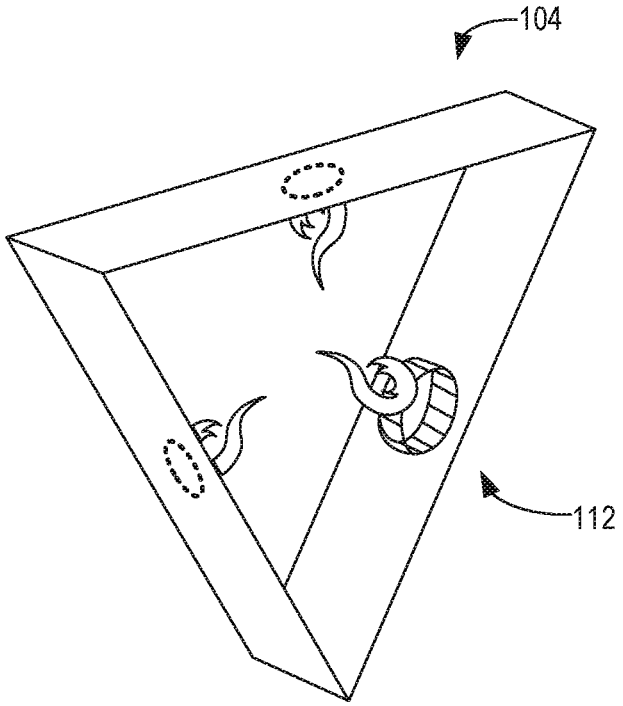

The exemplifications set out herein illustrate exemplary embodiments of the disclosure, and such exemplifications are not to be construed as limiting the scope of the disclosure in any manner.

DESCRIPTION

The following description is provided to enable those skilled in the art to make and use the described embodiments contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting According to one non-limiting embodiment, the present disclosure is directed to a torch device that comprises: a housing having a thermal energy source positioned therein; an ignition button operatively connected to the thermal energy source; and a thermal energy producing structure extending from a first end of the housing and operatively connected to the thermal energy source. The thermal energy producing structure comprises an inner surface, an outer surface, an opening defined by the inner surface, and at least one orifice positioned around a periphery of the thermal energy producing structure such that thermal energy produced at the at least one opening is distributed evenly around a peripheral circumference of an object positioned within the opening. The present disclosure is also directed to a thermal energy producing structure configured to be coupled to a handheld housing having a thermal energy source positioned there. The thermal energy producing structure comprises: an inner surface; an outer surface; an opening defined by the inner surface; and at least one orifice positioned around a periphery of the thermal energy producing structure such that thermal energy produced at the at least one orifice is distributed evenly around a peripheral circumference of an object positioned within the opening.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. As used in the specification and the claims, the singular form of "a", "an", and "the" include plural referents unless the context clearly dictates otherwise.

Reference is made to FIGS. 1A-1B, which show a torch device 100. The torch device 100 may include a housing 102 and a thermal energy producing structure 104. The housing 102 and the thermal energy producing structure 104 may be integral with each other. Alternatively, the thermal energy producing structure 104 may be configured to be removably attached to the housing 102. The housing 102 may make up the lower portion of the torch device 100 and the thermal energy producing structure 104 may make up the upper portion of the torch device 100. The housing 102 may be ergonomically shaped such that it can be handheld by a user.

With continued reference to FIGS. 1A-1B, the thermal energy producing structure 104 may have a circular configuration such that the thermal energy producing structure 104 defines an inner surface 106, an outer surface 108, and a circular opening 110 defined by the inner surface 106. In such a configuration, the opening 110 may be a fully enclosed circle, into which an object, such as a cigar, may be inserted. The thermal energy producing structure 104 may vary in size. The thermal energy producing structure 104 may be made of any suitable material, such as stainless steel. Referring to FIGS. 2A-5B, the thermal energy producing structure 104 may be in any suitable shape. For example, the thermal energy producing structure 104 may be configured to be in a triangular shape, a rectangular shape, or any shape with any number of sides. Alternatively, the thermal energy producing structure 104 may not be fully closed. For example, there may be a gap present in the thermal energy producing structure 104 such that the thermal energy producing structure 104 may not be a full circle, triangle, rectangle, square, etc.

With continued reference to FIGS. 1A-1B, the thermal energy producing structure 104 may include at least one orifice. In non-limiting embodiments, the orifice may include a plurality of nozzles 112 each having a port. The port of the plurality of nozzles 112 provides an exit for fuel to escape from the torch device 100. The exiting fuel may be ignited such that a flame is created at the plurality of nozzles 112. While a flame is described, any suitable type of thermal energy may be utilized. The plurality of nozzles 112 may be placed on the inner surface 106 of the thermal energy producing structure 104. The ports of the plurality of nozzles 112 may be directed towards the center of the opening 110. In this manner, the flame created at the plurality of nozzles 112 is directed towards the center of the opening 110. The sizes of the ports of the plurality of nozzles 112 may be controlled to vary the size and shape of the flame to a user's preference.

With reference to FIG. 1A, the ports of the plurality of nozzles 112 may be elongated as to provide a flame with a flat appearance. The plurality of nozzles 112 may protrude outwardly from the inner surface 106 of the thermal energy producing structure 104. Alternatively, as shown in FIG. 1B, the plurality of nozzles 112 may be smaller to provide multiple smaller flames. The plurality of nozzles 112 may be flush against the inner surface 106 of the thermal energy producing structure 104. The plurality of nozzles 112 may provide a plurality of flames that evenly provide heat to the periphery of an object, such as a cigarette or cigar. Each of the plurality of nozzles 112 may be different in size and shape. In other non-limiting embodiments, the at least one orifice may be embodied as a continuous channel extending around the periphery of the thermal energy producing structure 104. In still another non-limiting embodiment, the at least one orifice may be positioned on a front face of the thermal energy producing structure 104 such that the flames are directed toward the object, such as a cigar or cigarette.

With continued reference to FIGS. 1A-1B, the housing 102 may contain a fuel tank 114. The housing 102 and the thermal energy producing structure 104 may include a fuel tube 120. The fuel tube 120 delivers fuel from the fuel tank 114 to the thermal energy producing structure 104. The fuel tube 120 may be made of any suitable material. The thermal energy producing structure 104 may include a fuel tube 122 that receives fuel from the fuel tube 120 of the housing 102. The fuel tube 122 may be defined by the inner surface 106 and the outer surface 108 of the thermal energy producing structure 104. The fuel tube 122 terminates at the ports of the plurality of nozzles 112. The fuel tube 122 delivers fuel received from the housing 102 to the ports of the plurality of nozzles 112. The fuel tank 114 may contain any fuel, which may be any suitable flammable material, that may adequately be expelled through the plurality of nozzles 112. For example, the fuel may be butane or liquid fuel. As an alternative, a battery may be provided as an energy source in the housing 102 rather than the fuel tank 114. In such a configuration, the battery is electrically coupled via a wire to resistive or other electrical heating elements extending from the nozzles 112 to thereby provide an electrical version of the torch device.

With continued reference to FIGS. 1A-1B, once the fuel reaches the plurality of nozzles 112, the fuel exits the torch device 100 via the ports of the plurality of nozzles 112. The release of the fuel from the fuel tank 114 may be initiated by pressing the ignition button 116 placed on the housing 102. The ignition button 116 may be placed on any outer surface of the housing 102. For example, the ignition button 116 may be placed on a side of the housing 102. The ignition button 116 may be in any suitable size or shape. A user may press and hold the ignition button 116 to continuously release fuel from the fuel tank 114. The user may then release the ignition button 116 to stop the flow of the fuel from the fuel tank 114 to the plurality of nozzles 112. Alternatively, the user may press the ignition button 116 once to continuously release fuel, and press the ignition button 116 once more to stop the flow of the fuel from the fuel tank 114 to the plurality of nozzles 112.

With continued reference to FIGS. 1A-1B, the torch device 100 may include an electrical ignition wire 118. One end of the electrical ignition wire 118 may be placed within the housing 102 such that it can interact with the ignition button 116 when the ignition button 116 is in its pressed position. The other end of the electrical ignition wire 118 may terminate at the plurality of nozzles 112. When a user presses the ignition button 116, the ignition button 116 may come in contact with the electrical ignition wire 118. The interaction between the electrical ignition wire 118 and the ignition button 116 may create a charge. The charge travels to the other end of the electrical ignition wire 118 placed at the plurality of nozzles 112. As discussed above, pressing the ignition button 116 triggers release of fuel at the plurality of nozzles 112. The charge combusts the fuel at the plurality of nozzles 112, thereby creating the flame.

With continued reference to FIGS. 1A-1B, once the flame is ignited at the plurality of nozzles 112, the flame is directed to the center of the opening 110. A user may then insert an object, such as a cigar or cigarette, into the center of the opening 110. In this manner, the torch flame device 100 distributes heat evenly across the peripheral circumference of the object. All sides of the object are allowed to combust at the same rate. The user may configure the size of each of the ports of the plurality of nozzles 112 to control the intensity of flame coming from each of the plurality of nozzles 112 to the user's preference.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure that are known or customarily practiced in the art to which this disclosure pertains and which fall within the limits of the appended claims.

The invention claimed is:

1. A torch device comprising:

a housing having a thermal energy source positioned therein;

an ignition button operatively connected to the thermal energy source; and a thermal energy producing structure extending from a first end of the housing and operatively connected to the thermal energy source, wherein the thermal energy producing structure comprises an inner surface, an outer surface, an opening defined by the inner surface, and at least one continuous orifice formed as a continuous channel extending around a periphery of the thermal energy producing structure such that thermal energy is produced at the at least one continuous orifice, discharged by the at least one continuous orifice into the opening, and distributed evenly around a peripheral circumference of an object positioned within the opening.

2. The device of claim 1, wherein the thermal energy source comprises a fuel tank configured to store fuel and the device further comprises an electrical ignition wire positioned within the housing and configured to ignite the fuel when activated by the ignition button.

3. The device of claim 2, wherein the ignition button is configured to ignite the fuel at the at least one orifice and allow fuel to flow from the fuel tank to the at least one orifice.

4. The device of claim 1, wherein the thermal energy source comprises at least one battery and the device further comprises at least one wire connected between the at least one battery and at least one resistive heating element positioned within the at least one orifice that is configured to be activated by the ignition button.

5. The device of claim 1, wherein the opening defined by the inner surface is a closed loop.

6. The device of claim 5, wherein the closed loop is circular.

7. The device of claim 5, wherein the closed loop defines at least three distinct sides.

8. The device of claim 7, wherein the at least three distinct sides form a shape chosen from a group consisting of: a triangle, a rectangle, a pentagon, a hexagon, and a heptagon.

9. The device of claim 1, further comprising a plurality of nozzles disposed on the inner surface of the thermal energy producing structure.

10. The device of claim 9, wherein the plurality of nozzles protrudes outwardly from the inner surface.

11. The device of claim 9, wherein the plurality of nozzles is flush on the inner surface of the housing.

12. A thermal energy producing structure configured to be coupled to a handheld housing having a thermal energy source positioned therein, the thermal energy producing structure comprising:

an inner surface;

an outer surface;

an opening defined by the inner surface; and at least one continuous orifice formed as a continuous channel extending around a periphery of the thermal energy producing structure such that thermal energy is produced at the at least one continuous orifice, discharged by the at least one continuous orifice into the opening, and distributed evenly around a peripheral circumference of an object positioned within the opening.

13. The structure of claim 12, wherein the opening defined by the inner surface is a closed loop.

14. The structure of claim 13, wherein the closed loop is circular.

15. The structure of claim 13, wherein the closed loop defines at least three distinct sides.

16. The structure of claim 15, wherein the at least three distinct sides form a shape chosen from a group consisting of: a triangle, a rectangle, a pentagon, a hexagon, and a heptagon.

17. The structure of claim 12, further comprising a plurality of nozzles disposed on the inner surface of the structure.

18. The structure of claim 17, wherein each of the plurality of nozzles protrudes outwardly from the inner surface.

19. The structure of claim 17, wherein each of the plurality of nozzles is flush on the inner surface of the structure.

20. The structure of claim 17, wherein each of the plurality of nozzles is configured to direct the thermal energy towards the center of the opening.

* * * * *